US008247674B2

(12) United States Patent
Corts et al.

(10) Patent No.: US 8,247,674 B2
(45) Date of Patent: Aug. 21, 2012

(54) SLIDE BAR HOLDER

(75) Inventors: Timothy J. Corts, West Paducah, KY (US); George D. Free, Kevil, KY (US)

(73) Assignee: Fretworks LLC, Bandana, KY (US)

( * ) Notice: Subject to any disclaimer, the term of this patent is extended or adjusted under 35 U.S.C. 154(b) by 0 days.

(21) Appl. No.: 13/208,470

(22) Filed: Aug. 12, 2011

(65) Prior Publication Data

US 2012/0144973 A1 Jun. 14, 2012

(51) Int. Cl.
*G10D 3/08* (2006.01)

(52) U.S. Cl. ..... 84/327; 84/329

(58) Field of Classification Search ..... 84/315–319, 84/327, 329

See application file for complete search history.

(56) References Cited

U.S. PATENT DOCUMENTS

| | | | | |
|---|---|---|---|---|
| 5,739,445 | A | 4/1998 | Terry et al. | |
| 6,323,409 | B1 | 11/2001 | Surber | |
| 7,238,871 | B1 | 7/2007 | Stroscio | |
| 7,947,886 | B2 * | 5/2011 | Hoyle | 84/315 |

* cited by examiner

*Primary Examiner* — Kimberly Lockett
(74) *Attorney, Agent, or Firm* — Luedeka Neely Group, P.C.

(57) ABSTRACT

A slide bar holder removably secures a slide bar to a stringed musical instrument. The slide bar holder includes an instrument attachment clip and a slide bar clip. The instrument attachment clip has an elongate central portion and a pair of opposing jaws disposed at opposite ends of the central portion which extend from the central portion in a first direction. The jaws of the instrument attachment clip are operable to removably receive the body portion of the musical instrument and thereby secure the slide bar holder to the musical instrument. The slide bar clip has a pair of opposing jaws that extend from the central portion of the instrument attachment clip in a second direction that is opposite the first direction. The jaws of the slide bar clip are spaced apart by a distance substantially equivalent to the diameter of the slide bar, such that the jaws of the slide bar clip are operable to removably receive and secure the slide bar in the slide bar holder.

20 Claims, 4 Drawing Sheets

SLIDE BAR HOLDER

RELATED APPLICATION

This application claims priority to provisional patent application Ser. No. 61/459,544, filed Dec. 13, 2010, titled "Slide Bar Safe," the entire contents of which are incorporated herein by reference.

FIELD

The present invention relates generally to an accessory for a musical instrument, and more specifically to a holder for removably securing a slide bar to a musical instrument, such as a guitar.

BACKGROUND

Slide bars for guitars have been in use for years. Due to the ever increasing popularity of the use of slide bars, slide bar holders have been introduced.

Prior devices include the "Slide Bar Pouch" described in U.S. Pat. No. 7,238,871. Generally, this device provides a pouch for holding the slide bar when not in use by the performer. Though this device does indeed hold the slide bar, its design makes it nearly impossible for the performer to retrieve the slide bar from the pouch or replace it into the pouch without great difficulty. This device fails to provide for rapid, efficient, and secure placement and replacement of the slide bar in a convenient location on the instrument.

U.S. Pat. No. 6,323,409 describes a "Slide Bar Clip." This device is apparently made of a pliable, bendable bar of metal with its surface covered in a felt or rubber material to protect the finish of the instrument. One end of the device is shaped to conform to the depth of the guitar or other instrument. The other end is shaped to allow the slide bar to be placed within a sort of clip which is expected to hold the slide bar in place while not in use. This device has several disadvantages. First, the section that bends around the body of the instrument will inevitably fail because of eventual metal fatigue. Secondly, the clip portion of the device that actually holds the slide bar while not in use would likely fail for the same reason. Finally, the design of the clip extends the arm of the clip inside the barrel of the slide bar. This renders the clip nearly useless because the arm of the clip prevents easy and comfortable entry of the finger of the performer into the barrel of the slide bar. Further, the replacement of the slide bar is clumsy, uncomfortable, and in most cases results in fumbling or dropping the slide bar altogether.

U.S. Pat. No. 5,739,445 describes a "Guitar Slide Bar Holder" which is an elastic tubular band of material attached to the back of a guitar strap. This device also has several disadvantages. First, the device is nearly inaccessible to the slide bar finger hand of the performer. In other words, it would be very difficult to access the slide bar quickly, and nearly impossible to replace it quickly. Further, after removal from the device, the elastic will most likely collapse, making it extraordinarily difficult for the performer to replace the slide bar with one hand. The performer will likely have to use the other hand to re-open the elastic surface of the barrel shaped device.

All of the aforementioned devices fail to provide a fast, easy, efficient and secure structure in which the slide bar can be placed, retained, retrieved and replaced without undo burden on the performer. The main problems associated with these conventional slide bar holders are: (1) they do not allow the performer to have easy, quick, and secure access to the slide bar; (2) they do not provide a way to replace the slide bar easily, efficiently and quietly so that the slide bar may be retrieved at any time without dropping it; and (3) they do not allow the performer to quickly, comfortably and securely place a finger back into the slide bar for retrieval. While these other devices may be suitable for some purposes, they do not provide the performer an easy, fast, quiet and secure method of retrieving and replacing a guitar slide bar in any given type of performance venue or situation.

SUMMARY

Various embodiments of the present invention provide a performer an easy, fast, quiet and secure method of retrieving and replacing a guitar slide bar in any given type of performance venue or situation. These embodiments eliminate the need to: (1) have several different slide bars on hand, (2) wear the slide bar at inconvenient times during a performance, (3) have someone hand the performer a slide bar for use during a performance, (4) drop the slide bar onto the floor during a performance or place it on a table or other surface that is inconvenient or out of the way to the performer, or (5) "pocket" the slide bar, and in doing so, find it difficult if not nearly impossible to retrieve it for a later use.

In these respects, the present invention substantially departs from the conventional concepts and designs of the prior art, and in so doing provides a small, unobtrusive and attractive package that eliminates the problems associated with the prior art slide holders. To attain this, one embodiment of the present invention generally comprises two clips made of very light-weight material that are fixed together and juxtaposed at their joint. The clips may be made of highly-durable and dense plastic or polymer formed by injection molding or other similar process. The larger of the two clips fastens comfortably, safely and securely to the body of the instrument, while the second clip, preferably made of a unique memory style polymer plastic, safely, efficiently and quietly secures the slide bar within its jaws when the slide bar is not in use. The first clip, also referred to herein as an "instrument attachment clip," is the larger of the two clips, and is intended to securely moor itself to the body of the instrument in a location that the performer considers to be the most convenient for quick retrieval and replacement of the slide bar.

The second clip, also referred to herein as the "slide bar clip," is preferably the smaller of the two clips and attaches to the first clip at an angle of about 90 degrees with respect to the first clip. The second clip retains the slide bar as needed until the performer removes it from the jaws of the second clip during a performance. The performer may then reattach the slide bar into the jaws of the second clip as necessary, where it is firmly and comfortably retained until needed later. The second clip is approximately one to three inches long with opposing jaws that quietly and efficiently accept any and all sizes of slide bars quickly with a firm grip upon the body of the slide bar until the performer needs it.

One object of the present invention is to provide a wholly unique slide bar holder that overcomes the shortcomings of the prior art devices.

It is also an object of the present invention to provide the user with the easiest, fastest, most quiet and secure method of retrieving and replacing a guitar slide bar in any given type of performance venue or situation.

Another object is to provide the user extremely quick and very easy access to the user's slide bar at any given time during the course of the user's performance.

Another object is to provide an extremely fast method by which the user may reattach a slide bar into its holder.

Another object is to provide a slide bar holder that does not require the user to have multiple slide bars at the user's disposal, which will in turn be very efficient and less costly to the user.

Another object is to provide a slide bar holder that will keep the user from misplacing or losing the slide bar.

Another object is to provide a device that provides "flick of the finger" quickness in obtaining and then replacing the slide bar into its original position in a holder.

Another object is to provide a slide bar holder that allows the user to be hands free of the slide bar at any given time during the performance when the slide bar is not in use.

Another object is to provide a new and unique slide bar holder that will forever change the way all users approach the best possible way to safely, quietly and conveniently secure a slide bar in any given venue, so as to quickly attach the slide bar to their finger and efficiently reattach it to the holder until the slide bar is needed again.

Other objects and advantages of the present invention will become apparent upon review of the detailed description provided below, and it is intended that these objects and advantages be within the scope of the present invention.

The above and other objects are accomplished by a slide bar holder for removably securing a slide bar to a stringed musical instrument. The slide bar holder includes an instrument attachment clip and a slide bar clip. The instrument attachment clip has an elongate central portion and a pair of opposing jaws disposed at opposite ends of the central portion which extend from the central portion in a first direction. The jaws of the instrument attachment clip are operable to removably receive the body portion of the musical instrument and thereby secure the slide bar holder to the musical instrument. The slide bar clip has a pair of opposing jaws that extend from the central portion of the instrument attachment clip in a second direction that is opposite the first direction. The jaws of the slide bar clip are spaced apart by a distance substantially equivalent to the diameter of the slide bar, such that the jaws of the slide bar clip are operable to removably receive and secure the slide bar in the slide bar holder.

In some preferred embodiments, the jaws of the slide bar clip are oriented substantially perpendicular with respect to the jaws of the instrument attachment clip.

In some preferred embodiments, the slide bar holder includes a cradle disposed on the central portion of the instrument attachment clip. The cradle has one or more cradle members for receiving the slide bar when the slide bar is inserted between the jaws of the slide bar clip. In one embodiment, the cradle includes two cradle members disposed on opposing sides of the slide bar clip.

In some preferred embodiments, the slide bar holder has a central opening extending through the central portion of the instrument attachment clip. This central opening is disposed between the jaws of the slide bar clip and between the cradle members of the cradle.

BRIEF DESCRIPTION OF THE DRAWINGS

Further advantages of the invention are apparent by reference to the detailed description in conjunction with the figures, wherein elements are not to scale so as to more clearly show the details, wherein like reference numbers indicate like elements throughout the several views, and wherein.

DETAILED DESCRIPTION

Figure 3A:
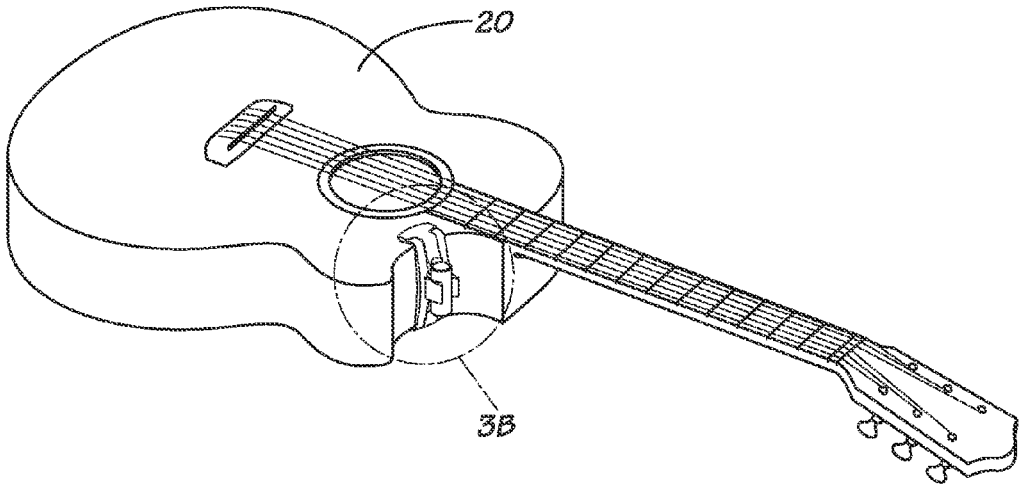
FIGS. 3A and 3B depict perspective views of a preferred embodiment of a slide bar holder attached to the body of a guitar.
Figure 3B:
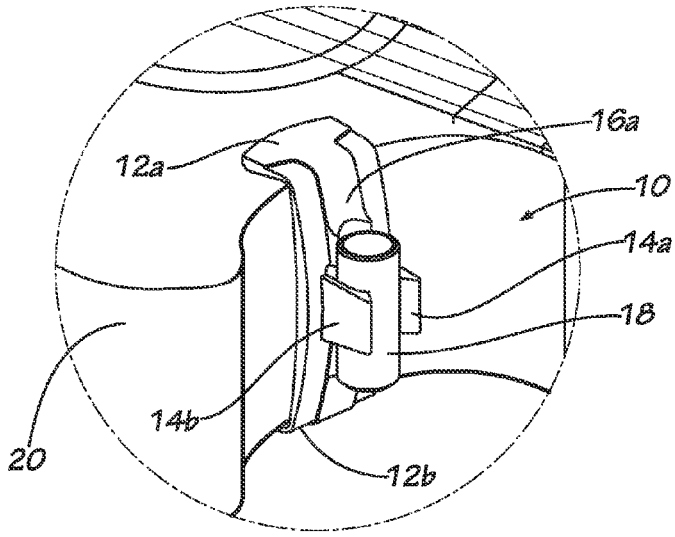
Figure 4:
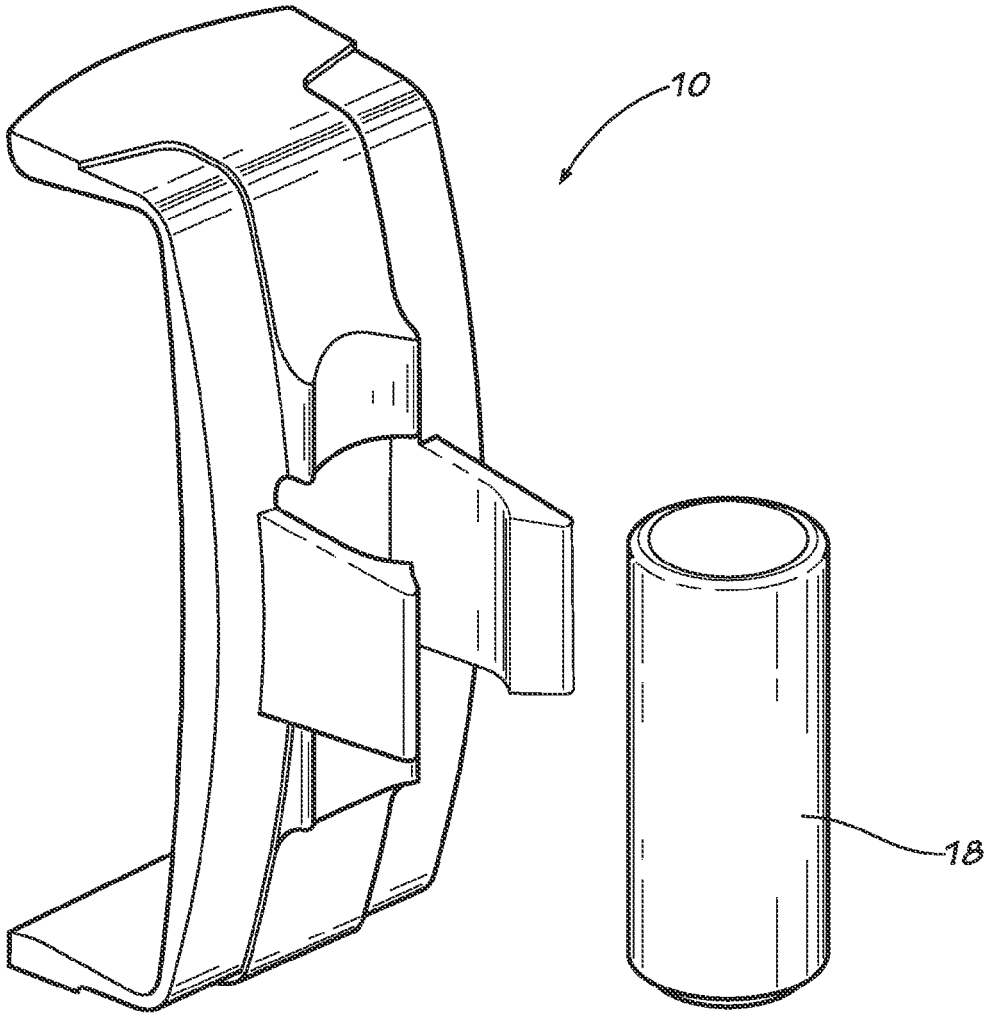
FIG. 4 depicts a perspective view of a preferred embodiment of a slide bar holder and a slide bar positioned for insertion into the slide bar holder.

FIGS. 1A-1D, 2, 3A-3B, and 4 depict a preferred embodiment of a slide bar holder 10 which includes a large first clip 12, also referred to herein as an instrument attachment clip, and a smaller second clip 14, also referred to herein as a slide bar clip. The first clip 12 and the second clip 14 are preferably affixed together in an orthogonal relationship. Both clips 12 and 14 are preferably made of highly-durable, rigid, lightweight, and dense plastic or polymer. The larger first clip 12 has a central portion 12*c* disposed between a pair of opposing jaws 12*a*-12*b*, also referred to herein as first jaws, that flex outward somewhat to receive the body of an instrument 20, such as a guitar (FIG. 3A). The smaller second clip 14 has a pair of opposing jaws 14*a*-14*b*, also referred to herein as second jaws, attached to the central portion 12*c* of the first clip 12. The jaws 14*a*-14*b* are operable to flex outward somewhat to receive a slide bar 18 (FIG. 3B) into a cradle 16 when the slide bar 18 is not in use. The first clip 12 may be attached to the body of the instrument 20 in a location that the user considers to be the most convenient and provides for the fastest retrieval and replacement of the slide bar 18.

The purpose of the first clip 12 is to attach to the body of the acoustic or electric instrument 20 at a location that is convenient and most useful to the performer, such as the position depicted in FIG. 3A. In most cases the clip 12 will be attached on the upper portion (or upper bout) of the instrument 20 near the joint where the neck and the body of the instrument are joined together. The clip 12 is preferably formed of a memory-style polymer/plastic will gently yet firmly secure the holder 10 in place during use of the instrument 20. For example, the clip 12 may be molded from polymeric materials and/or compounds including but not limited to Ethylene Vinyl Acetate, Polypropylene, SIS and SBS rubber compounds, acrylonitrile-butadiene styrene terpolymer, Santoprene, Amorphous polyolefin, and ethylene-methyl Acrylate copolymer.

The purpose of the second clip 14 is to firmly hold the slide bar so that the user may retrieve it for use and then quickly reattach it in the clip's jaws 14*a*-14*b* until it is needed again. The clip 14 is also made of a polymer plastic with memory so that it too will accommodate any size slide bar 18 comfortably and firmly.

The cradle 16 preferably includes first and second cradle members 16*a*-16*b* disposed on either side of the jaws 14*a*-14*b* on the central portion 12*c* of the first clip 12. The radius of the surfaces of the cradle members 16*a*-16*b* that receive the slide bar 18 is preferably the same as the outer radius of the slide bar 18. The cradle members 16*a*-16*b* provide a firm base for the slide bar 18 and prevent undesired lateral rotation of the slide bar 18 while in the clip 14.

The first and second clips 12 and 14 are preferably formed as a single continuous component in an injection molding process or similar manufacturing process. In alternative embodiments, the clips 12 and 14 may be formed as separate pieces which snap together or otherwise attach together, either permanently or removably.

As shown in the figures, the second clip 14 is preferably rotated at angle of about 90 degrees with respect to the first clip 12, and the jaws 14*a*-14*b* of the second clip 14 face in an opposite direction with respect to the jaws 12*a*-12*b* of the first clip 12. In other embodiments, the angular relationship between the two clips 12 and 14 may be other than 90 degrees, and may be set at an angle which provides the greatest ease of use for the performer. In one embodiment, a rotational mechanism may be provided which would allow the user to rotate the second clip 14 with respect to the first clip 12 to adjust the angular orientation according to the user's preference.

The first clip 12 is generally rectangular and U-shaped, and the jaws 12*a*-12*b* and the central portion 12*c* have a width of about 0.75 to 1.50 inch. Each of the jaws 12*a*-12*b* is preferably about 1.50 to 4 inches in length, but may be as short as about one inch or as long as about 6 inches. As shown in FIG. 1D, thickness of the jaws 14*a*-14*b* is greater at the ends of the jaws that extend out from the central portion 12*c* of the first clip 12. This provides for receiving the slide bar 18 in a snap-fit arrangement wherein the slide bar 18 is effectively captured between the opposing jaws 14*a*-14*b*.

Figure 1A:
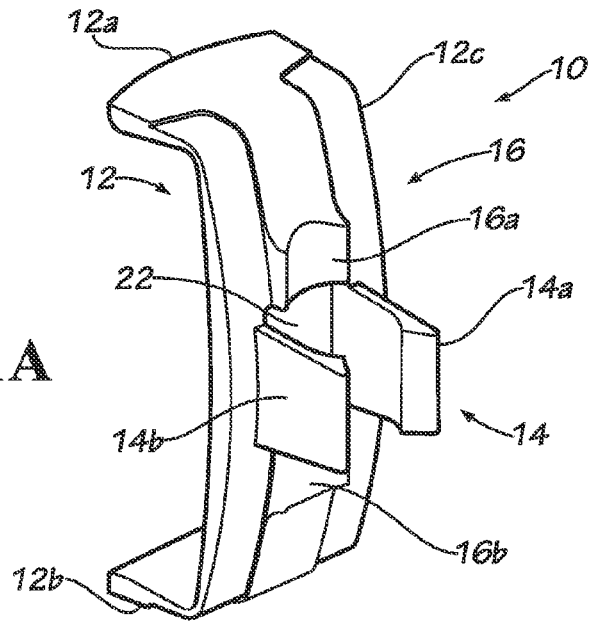
FIGS. 1A, 1B, 1C and 1D depict a slide bar holder according to a preferred embodiment of the invention.
Figure 1B:
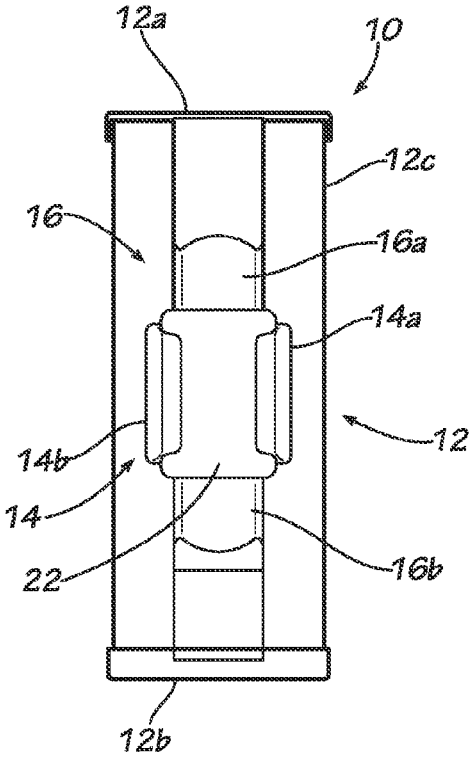
Figure 1C:
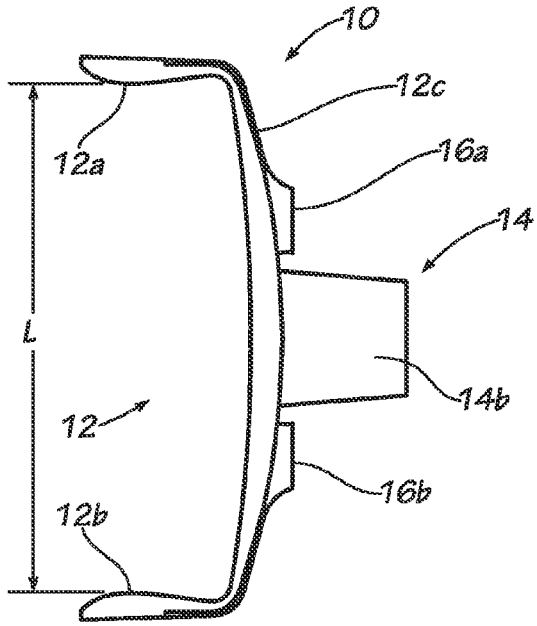
Figure 1D:
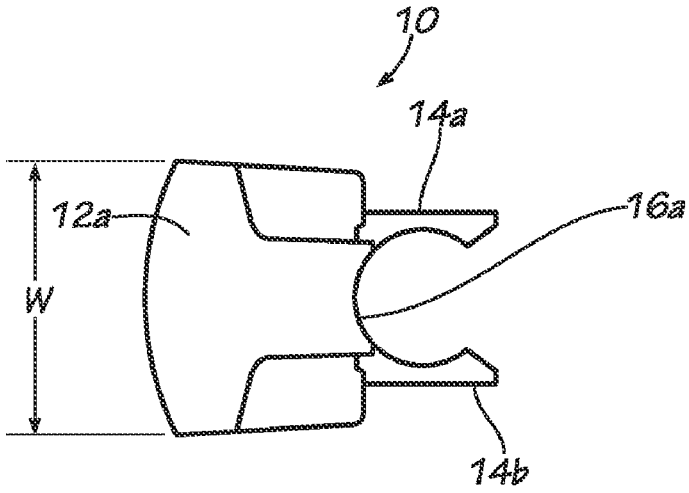
Figure 2:
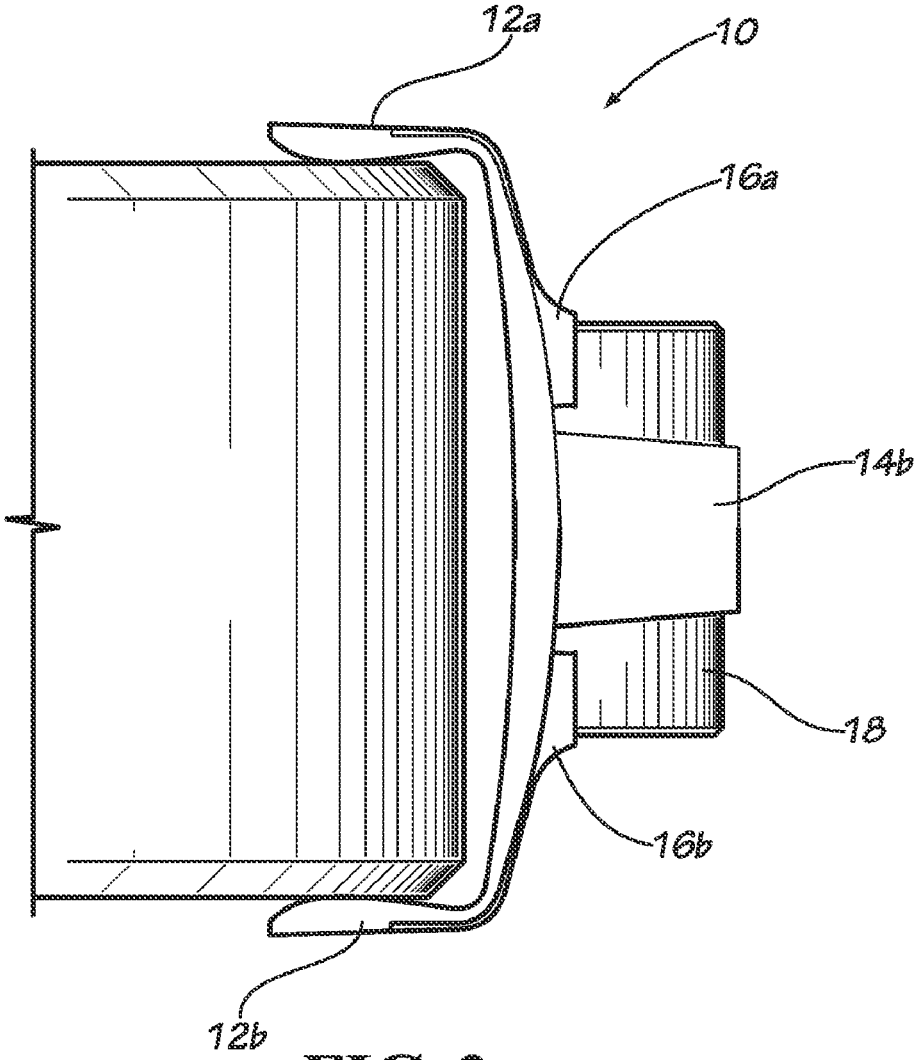
FIG. 2 depicts a side view of a preferred embodiment of a slide bar holder attached to the body of a guitar.

As shown in FIGS. 1B and 1C, a preferred embodiment of the slide bar holder 10 includes a central opening 22 through the central portion 12*c* of the first clip 12. The central opening 22 is preferably disposed between the jaws 14*a*-14*b* and between the cradle members 16*a*-16*b*. The opening 22 provides a release point from the injection mold. It also reduces the amount of costly polymeric material needed, thereby lowering the overall cost of the holder 10.

Various embodiments of the slide bar holder 10 may be placed or mounted anywhere on the body of any given stringed instrument. Although there are several design/model options for the holder 10, all are very similar in their basic design, but have varying dimensions for the spacing between the jaws 12*a*-12*b*. The purpose of the various models is to accept acoustic and electric stringed instruments having various body depths.

Some embodiments of the slide bar holder 10 include a thin layer of non-slip material disposed on the inside clamping surfaces of the jaws 12*a*-12*b* that contact the surfaces of the instrument 20 to which the holder 10 is attached. This prevents unwanted slippage between the slide bar holder 10 and the instrument 20 and protects the finish of the instrument. Some embodiments may also include such a material on the inner surfaces of the cradle members 16*a*-16*b* and on the inner surfaces of the jaws 14*a*-14*b* of the second clip 14 so as to silence or deaden any noise which may emanate when the slide bar 18 is inserted into the second clip 14. Preferably, this material is a synthetic non-woven or microfiber material which is similar to felt, such as, but not limited to Duratech™.

As discussed previously, in a preferred embodiment of the slide bar holder 10 there are no subcomponent parts involved because the first clip 12 and the second clip 14 are permanently enjoined together in the manufacturing process, such as by a one-piece injection molding process. Further, since the device is preferably manufactured using space-age polymer plastics, there is no need for spring or clamps. Rather the device utilizes "memory" polymers to form fit around the body of the instrument as well as the barrel of the slide bar.

As mentioned previously, there may be multiple versions of the slide bar holder 10 having different dimensions for the space between the jaws 12*a*-12*b* of the first clip 12 so as to accommodate multiple instruments having different body depths. For example, one version of the holder 10 may be designed with six inches between the jaws 12*a*-12*b* for use on acoustic guitars. Another version of the holder 10 may be designed with two inches between the jaws 12*a*-12*b* for use on electric guitars. In one embodiment, the main portion 12*c* of the first clip 12 includes a sliding and locking mechanism which allows the dimension between the jaws 12*a*-12*b* to be adjustable.

The foregoing description of preferred embodiments for this invention have been presented for purposes of illustration and description. They are not intended to be exhaustive or to limit the invention to the precise form disclosed. Obvious modifications or variations are possible in light of the above teachings. The embodiments are chosen and described in an effort to provide the best illustrations of the principles of the invention and its practical application, and to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A slide bar holder for removably securing a slide bar to a stringed musical instrument, the slide bar holder comprising:

an instrument attachment clip comprising:

an elongate central portion having a length and a width; and a pair of opposing first jaws disposed at opposite ends of the central portion and extending from the central portion in a first direction, the first jaws being operable to removably receive a body portion of the musical instrument between the first jaws and thereby secure the slide bar holder to the musical instrument; and a slide bar clip comprising a pair of opposing second jaws extending from the central portion of the instrument attachment clip in a second direction opposite the first direction, the second jaws being spaced apart by a distance substantially equivalent to a diameter of the slide bar, such that the second jaws are operable to removably receive and secure the slide bar in the slide bar holder.

2. The slide bar holder of claim 1 wherein the second jaws are oriented substantially perpendicular with respect to the first jaws.

3. The slide bar holder of claim 1 wherein a separation distance between the first jaws is substantially equivalent to the length of the central portion which corresponds to a thickness of the body portion of the musical instrument.

4. The slide bar holder of claim 1 further comprising a cradle disposed on the central portion of the instrument attachment clip, the cradle having one or more cradle members for receiving the slide bar when the slide bar is inserted between the second jaws of the slide bar clip.

5. The slide bar holder of claim 4 wherein the one or more cradle members each have a surface for receiving the slide bar, the surface having has a radius that is substantially equivalent to an outer radius of the slide bar.

6. The slide bar holder of claim 4 wherein the one or more cradle members comprise two cradle members disposed adjacent the slide bar clip and on opposing sides thereof.

7. The slide bar holder of claim 1 further comprising a central opening extending through the central portion of the instrument attachment clip, the central opening disposed between the second jaws of the slide bar clip.

8. The slide bar holder of claim 6 further comprising a central opening extending through the central portion of the instrument attachment clip, the central opening disposed between the second jaws of the slide bar clip and between the two cradle members of the cradle.

9. The slide bar holder of claim 1 wherein the instrument attachment clip and the slide bar clip are formed from one continuous piece of plastic.

10. The slide bar holder of claim 1 wherein the instrument attachment clip and the slide bar clip are formed of plastic in an injection molding process.

11. The slide bar holder of claim 1 further comprising a layer of non-slip material disposed on surfaces of the first jaws that contact the body portion of the musical instrument when the body portion of the musical instrument is received between the first jaws.

12. The slide bar holder of claim 4 further comprising a layer of non-slip material disposed on surfaces of the one or more cradle members that contact slide bar when the slide bar is received between the second jaws.

13. The slide bar holder of claim 3 wherein the separation distance between the first jaws is about two inches to about 6 inches.

14. The slide bar holder of claim 3 wherein the separation distance between the first jaws is adjustable.

15. The slide bar holder of claim 1 wherein the width of the central portion of the instrument attachment clip is about 0.75 inch to about 1.5 inch.

16. The slide bar holder of claim 1 wherein the first jaws are about 1 inch to about 6 inches in length measured in the first direction.

17. The slide bar holder of claim 16 wherein the first jaws are about 1.5 inch to about 4 inches in length measured in the first direction.

18. A slide bar holder for removably securing a slide bar to a stringed musical instrument, the slide bar holder comprising:

an instrument attachment clip comprising:

an elongate central portion having a length and a width; and a pair of opposing first jaws extending from the central portion in a first direction, wherein a separation distance between the first jaws corresponds to a thickness of a body portion of the musical instrument, the first jaws being operable to removably receive the body portion of the musical instrument between the first jaws and thereby secure the slide bar holder to the musical instrument;

a slide bar clip comprising a pair of opposing second jaws extending from the central portion of the instrument attachment clip in a second direction opposite the first direction, the second jaws being oriented substantially perpendicular with respect to the first jaws, the second jaws being spaced apart by a distance substantially equivalent to a diameter of the slide bar, such that the second jaws are operable to removably receive and secure the slide bar in the slide bar holder; and a cradle disposed on the central portion of the instrument attachment clip, the cradle having one or more cradle members for receiving the slide bar when the slide bar is inserted between the second jaws of the slide bar clip.

19. The slide bar holder of claim 18 wherein the one or more cradle members each have a surface for receiving the slide bar, the surface having has a radius that is substantially equivalent to an outer radius of the slide bar.

20. The slide bar holder of claim 18 further comprising a central opening extending through the central portion of the instrument attachment clip, the central opening disposed between the second jaws of the slide bar clip.

* * * * *